US010434513B2

(12) United States Patent
Beebe et al.

(10) Patent No.: US 10,434,513 B2
(45) Date of Patent: Oct. 8, 2019

(54) METHOD AND DEVICE FOR CONTAINING EXPANDING DROPLETS

(71) Applicant: Wisconsin Alumni Research Foundation, Madison, WI (US)

(72) Inventors: David J. Beebe, Monona, WI (US); David J. Guckenberger, Jr., Oconomowoc, WI (US); Scott M. Berry, Madison, WI (US); Hannah M. Pezzi, New Berlin, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 615 days.

(21) Appl. No.: 15/176,932

(22) Filed: Jun. 8, 2016

(65) Prior Publication Data

US 2017/0356829 A1 Dec. 14, 2017

(51) Int. Cl.
*B01L 3/00* (2006.01)

(52) U.S. Cl.
CPC ..... *B01L 3/5088* (2013.01); *B01L 3/5085* (2013.01); *B01L 3/502792* (2013.01); *B01L 2300/0819* (2013.01); *B01L 2300/0858* (2013.01); *B01L 2300/165* (2013.01); *B01L 2400/086* (2013.01); *Y10T 436/2575* (2015.01)

(58) Field of Classification Search
CPC ..... B01L 3/5088; B01L 2200/027; B01L 3/502792; B01L 2400/086; B01L 2200/0642; B01L 2300/0819; B01L 2300/0858; B01L 3/5085; B01L 2300/165; B01L 3/502746; Y10T 436/2575; B81B 2203/0315
See application file for complete search history.

(56) References Cited

U.S. PATENT DOCUMENTS

| | | | |
|---|---|---|---|
| 7,186,548 | B2 | 3/2007 | Li |
| 8,945,486 | B2 | 2/2015 | Warrick et al. |
| 2007/0259366 | A1 | 11/2007 | Lawrence et al. |

(Continued)

FOREIGN PATENT DOCUMENTS

| | | |
|---|---|---|
| WO | 2004034012 | 4/2004 |

OTHER PUBLICATIONS

"Rapid DNA Isolation From Mammalian Cell Lysates Using The Gilson Extractman(TM)", Application Note TRANS0615, Gilson, Inc., Middleton, Wisconsin, 7 pages, undated. http://www.gilson.com/Resources/TRANS0615_EXTRACTMAN_DNA.pdf.

*Primary Examiner* — Lyle Alexander
*Assistant Examiner* — Bryan Kilpatrick
(74) *Attorney, Agent, or Firm* — Boyle Fredrickson, S.C.

(57) ABSTRACT

A method and microfluidic device are provided for containing a droplet having an outer surface at a predetermined location. The microfluidic device includes a plate having an upper surface and a central region communicating with the upper surface. The central region is adapted for receiving a droplet of fluid thereon. The central region includes an outer periphery that defines a first fluid constraint configured for discouraging fluid on the central region from flowing therepast. A second fluid constraint extends about the first fluid constraint. The second fluid constraint is configured for discouraging fluid flowing therepast. A third fluid constraint extends about the second fluid constraint. The third fluid constraint configured for discouraging fluid flowing therepast.

28 Claims, 2 Drawing Sheets

(56) References Cited

U.S. PATENT DOCUMENTS

| | | | | |
|---|---|---|---|---|
| 2010/0216228 | A1 | 8/2010 | Love et al. | |
| 2011/0212509 | A1* | 9/2011 | Beebe ..... | B01D 21/0009 435/283.1 |
| 2013/0101753 | A1 | 4/2013 | Eral et al. | |
| 2014/0255276 | A1 | 9/2014 | Warrick et al. | |

* cited by examiner

METHOD AND DEVICE FOR CONTAINING EXPANDING DROPLETS

REFERENCE TO GOVERNMENT GRANT

This invention was made with government support under CA 181648 awarded by the National Institutes of Health. The government has certain rights in the invention.

FIELD OF THE INVENTION

This invention relates generally to microfluidic devices, and in particular, to a method and device for containing expanding droplets at predetermined locations along a surface of a microfluidic device.

BACKGROUND AND SUMMARY OF THE INVENTION

With the ever increasing need to acquire more biological analytes from cells, biological protocols are becoming increasingly more complex. For instance, to capture both RNA and DNA from a sample including a single population of cells, a process that is desired but difficult with existing technology, a first buffer is necessary to lyse the cell membrane to expose the RNA. Thereafter, a second buffer must be combined with the first buffer to lyse the nuclear membrane, exposing the DNA. Additionally, different buffer conditions (e.g., salt concentrations) are necessary to promote the capture of RNA and DNA to magnetic beads. Hence, in order to sequentially extract RNA and DNA from a single sample, additional buffer must be added following the extraction of RNA to facilitate sequential DNA capture. Thus, strategies are needed to enable this "buffer addition" that are compatible with existing extraction techniques.

With the advent of Exclusion-based Sample Preparation (ESP), a simplified sample preparation process, droplets with convex menisci have proven advantageous. In ESP, the volumes of droplets of the samples/reagents are locked into specific narrow ranges. Hence, to accommodate variable sample/reagent volumes, multiple wells are needed. Each well has its own narrow volume range, thereby enabling users to utilize only the wells appropriate for each application. It can be appreciated that in order to do sequential capture of RNA and DNA, the droplets must be diluted. However, it is not possible to dilute a droplet of sufficient volume in a well that is already filled to a convex shape.

Currently, there are two options for buffer addition. First, following RNA removal, the remaining sample volume can be transferred to a new well, where an additional buffer is added. Unfortunately, this option requires sample transfer, which can lead to analyte loss, particularly for rare analytes. Second, the second buffer may be added directly to the initial sample well following RNA extraction. However, because the meniscus is already convex, filling the well further with the second buffer will likely cause the well to overflow. As a result, the sample may be lost.

Therefore, it is a primary object and feature of the present invention to provide a method and a device for containing expanding droplets at predetermined locations along a surface of a microfluidic device.

It is a further object and feature of the present invention to provide a method and a device for containing expanding droplets at predetermined locations along a surface along a microfluidic device that enables the droplets to be continuously enlarged, while maintaining a prescribed perimeter and a convex meniscus.

It is a further object and feature of the present invention to provide a method and a device for containing expanding droplets at predetermined locations along a surface of a microfluidic device that is simple to utilize and inexpensive to manufacture.

It is a still further object and feature of the present invention to provide a method and a device for containing expanding droplets at predetermined locations along a surface of a microfluidic device that is compatible with current sample preparation processes.

In accordance with the present invention, a microfluidic device is provided. The microfluidic device includes a plate having an upper surface and a central region communicating with the upper surface. The central region is adapted for receiving a droplet of fluid thereon. The central region includes an outer periphery that defines a first fluid constraint configured for discouraging fluid on the central region from flowing therepast. A second fluid constraint extends about the first fluid constraint. The second fluid constraint is configured for discouraging fluid flowing therepast. A third fluid constraint extends about the second fluid constraint. The third fluid constraint is configured for discouraging fluid flowing therepast.

The central region may include a recess formed in the upper surface of the plate. The recess is defined by a closed bottom spaced from the upper surface by a first sidewall. The first sidewall intersects the upper surface at a first edge. The first edge defines the first fluid constraint. The plate may also include a first channel in the upper surface. The first channel extends about the first sidewall and is defined by a first recessed surface spaced from the upper surface by a second sidewall. The second sidewall intersects the upper surface at a second edge. The second edge defines the second fluid constraint. The plate may also include a second channel in the upper surface. The second channel extends about the second sidewall and is defined by a second recessed surface spaced from the upper surface by a third sidewall. The third sidewall intersects the upper surface at a third edge. The third edge defines the third fluid constraint. The first channel has a volume. The volume of the first channel is greater than a volume of the second channel.

Alternatively, the first fluid constraint may include a first hydrophobic ring extending along the outer periphery of the central region and the second fluid constraint may include a second hydrophobic ring extending about the first fluid constraint. The second hydrophobic ring is radially spaced from the first hydrophobic ring. The third fluid constraint includes a third hydrophobic ring extending about the second fluid constraint. The third hydrophobic ring is radially spaced from the second hydrophobic ring.

In the alternative, a first sidewall may have a first end intersecting the outer periphery of the central region at a first edge and a second end. The first edge defines the first fluid constraint. A first ledge extends radially from the second end of the first sidewall and terminates at a terminal first edge. The terminal first edge defines the second fluid constraint. A second sidewall depends from the terminal first edge and terminates at a lower end. A second ledge extends radially from the lower end of the second sidewall and terminates at a terminal second edge. The terminal second edge defines the third fluid constraint.

In accordance with a further aspect of the present invention, a device is provided for containing a droplet having an outer surface at a predetermined location. The droplet has an internal pressure. The device includes a microfluidic device having a surface and a first fluid constraint extending about a first droplet area for receiving the droplet therein. The first fluid constraint is configured for maintaining the droplet within the first droplet area in response to the internal pressure of the droplet failing to exceed a first threshold. A second fluid constraint extends about and is spaced from the first fluid constraint by a second droplet area for receiving the droplet thereon. The second fluid restraint is configured for maintaining at least a portion of the droplet within the second droplet area in response to the internal pressure of the droplet failing to exceed a second threshold. A third fluid constraint extends about and is spaced from the second fluid constraint by a third droplet area for receiving the droplet thereon. The third fluid restraint is configured for maintaining at least a portion of the droplet within the third droplet area in response to the internal pressure of the droplet failing to exceed a third threshold.

The first droplet area may include a recess formed in the surface of the microfluidic device. The recess is defined by a closed bottom spaced from the surface by a first sidewall. The first sidewall intersects the surface at a first edge. The first edge defines the first fluid constraint. A first channel may be formed in the upper surface. The first channel extends about the first sidewall and is defined by a first recessed surface spaced from the upper surface by a second sidewall. The second sidewall intersects the surface at a second edge. The second edge defines the second fluid constraint. A second channel may be formed in the surface. The second channel extends about the second sidewall and is defined by a second recessed surface spaced from the surface by a third sidewall. The third sidewall intersects the surface at a third edge. The third edge defines the third fluid constraint. The first channel has a volume. The volume of the first channel may be generally equal to a volume of the second channel.

Alternatively, the first, second and third fluid constraints may be defined by corresponding concentric hydrophobic bands radially spaced from each other along the surface of the microfluidic device. In a further alternative, a fluid retainer extends from the surface of the microfluidic device and is defined by a plurality of steps such that the fluid retainer has a stepped pyramid configuration. Each step includes a rise generally perpendicular to the surface and a landing generally parallel to the surface wherein the intersection of each rise and landing combination defines a corresponding one of the first, second and third fluid constraints.

In accordance with a still further aspect of the present invention, a method is provided for containing an expandable droplet at a predetermined location along a surface of a microfluidic device. The method includes the steps of providing a plurality of radially spaced fluid constraints about a droplet deposit region of the surface of the microfluidic device and depositing a droplet within on the droplet deposit region of the surface of the microfluidic device. The droplet is retained within a first fluid constraint of the plurality of radially spaced fluid constraints if an internal pressure of the droplet is less than a first threshold. The droplet is retained within a second fluid constraint of the plurality of radially spaced fluid constraints if the internal pressure of the droplet is less than a second threshold. The droplet is retained within a third fluid constraint of the plurality of radially spaced fluid constraints if the internal pressure of the droplet is less than a third threshold.

The droplet deposit region may include a recess formed in the surface of the microfluidic device. The recess may include by a closed bottom spaced from the surface by a first sidewall. The first sidewall intersects the surface at a first edge. The first edge defines the first fluid constraint. A first channel may be provided in the upper surface. The first channel extends about and is radially spaced from the first sidewall and is defined by a first recessed surface spaced from the surface of the microfluidic device by a second sidewall. The second sidewall intersects the surface at a second edge. The second edge defines the second fluid constraint. A second channel may be provided in the surface. The second channel extends about and is radially spaced from the second sidewall and is defined by a second recessed surface spaced from the surface by a third sidewall. The third sidewall intersects the surface at a third edge. The third edge defines the third fluid constraint. The first channel has a volume. The volume of the first channel may be generally equal to a volume of the second channel.

Alternatively, the first, second and third fluid constraints may be defined by corresponding concentric hydrophobic bands radially spaced from each other along the surface of the microfluidic device. In a further alternative, a fluid retainer extends from the surface of the microfluidic device and is defined by a plurality of steps such that the fluid retainer has a stepped pyramid configuration. Each step includes a rise generally perpendicular to the surface and a landing generally parallel to the surface wherein the intersection of each rise and landing defines a corresponding one of the first, second and third fluid constraints.

BRIEF DESCRIPTION OF THE DRAWINGS

The drawings furnished herewith illustrate a preferred construction of the present invention in which the above aspects, advantages and features are clearly disclosed as well as others which will be readily understood from the following description of the illustrated embodiments.

In the drawings.

DETAILED DESCRIPTION OF THE DRAWINGS

Figure 1:
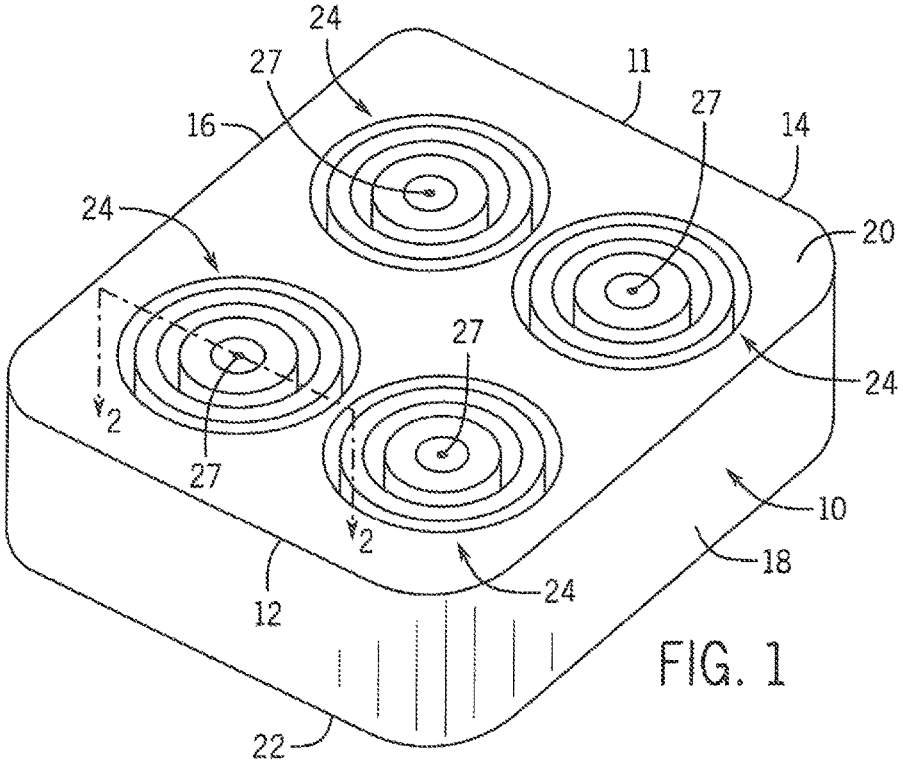
FIG. 1 is an isometric view of microfluidic device including a plurality of droplet retaining regions in accordance with the present invention for containing expanding droplets at predetermined locations along a surface thereof.

Referring to FIG. 1, a microfluidic device for use in the method of the present invention is generally designated by the reference numeral 10. In the depicted embodiment, microfluidic device 10 includes plate 11 defined by first and second ends 12 and 14, respectively; first and second sides 16 and 18, respectively; and upper and lower surfaces 20 and 22, respectively. It can be appreciated that plate 11 of microfluidic device 10 may have other configurations without deviating from the scope of the present invention.

Upper surface 20 of plate 11 includes a plurality of droplet receiving regions 24 formed therealong. Each of the droplet receiving regions 24 are identical in structure, and as such, the following description is understood to describe each of the microfluidic regions. Each droplet receiving region 24 includes recess 26 centered at center 27, FIGS. 2-3. In the depicted embodiment, recess 26 has a generally circular cross section.

However, it can be appreciated that recess 26 can have other configurations without deviating from the scope of the present invention. By way of example, recess 26 is defined by a generally circular wall 28 depending from and intersecting upper surface 20 at edge 30. Wall 28 is generally perpendicular to upper surface 20 and is radially spaced from center 27. Recess 26 terminates at a generally flat, lower wall 32 which is generally parallel to upper surface 20 and intersects lower end of wall 28.

Figure 2:
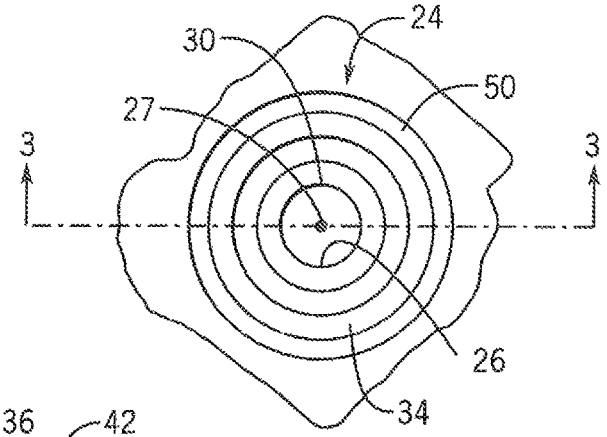
FIG. 2 is a top plan view of a droplet retaining region in accordance with the present invention taken along line 2-2 of FIG. 1.
Figure 3:
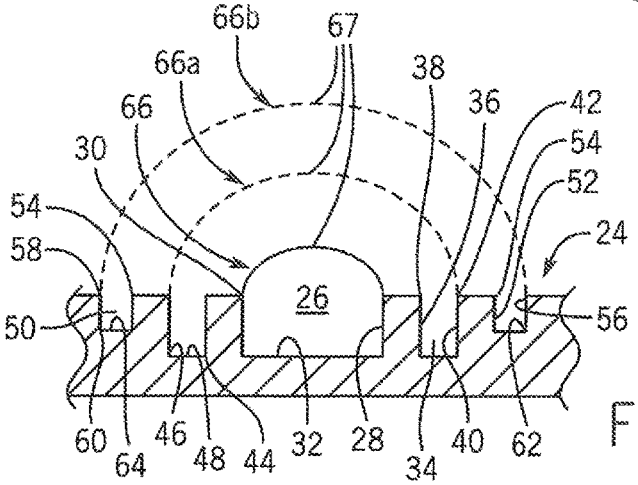
FIG. 3 is a cross-sectional view of the droplet retaining region of the present invention taken along line 3-3 of FIG. 2.

Each droplet receiving region 24 also includes a generally circular first channel, designated by the reference numeral 34, extending about and radially spaced from recess 26. It can be appreciated that first channel 34 can have other configurations without deviating from the scope of the present invention. As best seen in FIGS. 2-3, first channel 34 is defined by generally circular, radially inner wall 36 depending from and intersecting upper surface 20 at edge 38 and by a generally circular, outer wall 40 depending from and intersecting upper surface 20 at edge 42. Inner and outer walls 36 and 40, respectively, of first channel 34 are generally perpendicular to upper surface 20 and have lower ends 44 and 46, respectively, interconnected by lower wall 48.

A generally circular second channel, designated by the reference numeral 50, extends about and is radially spaced from first channel 34. It can be appreciated that second channel 50 can have other configurations without deviating from the scope of the present invention. As best seen in FIGS. 2-3, second channel 50 is defined by generally circular, radially inner wall 52 depending from and intersecting upper surface 20 at edge 54 and generally circular, outer wall 56 depending from and intersecting upper surface 20 at edge 58. Inner and outer walls 52 and 56, respectively, are generally perpendicular to upper surface 20 and have lower ends 60 and 62, respectively, interconnected by lower wall 64. It is contemplated for the volume of second channel 50 to approximate the volume of first channel 34.

In operation, it is contemplated to deposit on a droplet, generally designated by the reference numeral 66, on one or more droplet receiving regions 24 of plate 11. By way of example, a robotic micropipetting station (not shown) may be used to dispense droplets 66 onto droplet receiving regions 24 of plate 11 with a high degree of speed, precision, and repeatability. Each droplet 66 is initially received on recess 26 of droplet receiving region 24. The droplet 66 is retained within recess 26 by various fluidic constraints (e.g., hydrophobicity, surface tension, geometry). More specifically, recess 26 holds a threshold volume of fluid. With recess 26 filled with the fluid of droplet 66, edge 30 at the intersection of circular wall 28 and upper surface 20 acts to pin outer surface 67 of droplet 66 and retain the fluid of droplet 66 within recess 26. As additional fluid is added to droplet 66, e.g. by the adding of a reagent or a buffer directly to droplet 66, it can appreciated that size and surface area of droplet 66 increases. In addition, the size of the droplet 66 increases, the internal pressure of droplet 66 also increases. When the internal pressure of droplet 66 exceeds a threshold, droplet 66 breaks, thereby causing the fluid of droplet 66 to spill over edge 30 and flow radially outward from recess 26 toward first channel 34, as hereinafter described.

Once fluid of droplet 66 spills over edge 30, the fluid flows radially outward from recess 26 toward first channel 34. As the fluid is received in first channel 34, the size and shape of droplet 66 are no longer governed by the fluidic characteristics of recess 26, but by the various fluidic constraints of first channel 34 (e.g., hydrophobicity, surface tension, geometry). More specifically, as fluid in first channel 34 increases, droplet 66 increases in volume such that a first enlarged droplet **66*a* is formed within droplet receiving region 24. As best seen in FIG. 3, edge 42 at the intersection of outer wall 40 and upper surface 20 acts to pin outer surface 67 of first enlarged droplet 66*a* and retain the fluid of first enlarged droplet 66*a* within first channel 34. In the event that additional fluid is added to first enlarged droplet 66*a*, e.g. by the adding of a reagent or a buffer directly to first enlarged droplet 66*a*, it can appreciated that size of first enlarged droplet 66*a* increases and the surface area of outer surface 67 of first enlarged droplet 66*a* at edge 42 increases. When the internal pressure of first enlarged droplet 66*a* pinned at edge 42 exceeds a threshold, droplet 66*a* breaks, thereby causing the fluid of first enlarged droplet 66*a* to spill over edge 42 and flow radially outward toward second channel 50**, as hereinafter described.

Once fluid of droplet **66*a* spills over edge 42, the fluid flows radially outward from toward second channel 50. As the fluid is received in second channel 50, the size and shape of first enlarged droplet 66*a* are no longer governed by the fluidic characteristics of first channel 34, but by the various fluidic constraints of second channel 50 (e.g., hydrophobicity, surface tension, geometry). By way of example, in the depicted embodiment, the cross-sectional area of second channel 50 is less than the cross-sectional area of first channel 34. As a result, the volume of fluid receivable in second channel 50 is less than if the cross-sectional area of second channel 50 was equal to the cross-sectional area of first channel 34. Since second channel 50 has a greater circumference than first channel 34, the reduced cross-sectional area of second channel 50 allows for the volume of second channel 50 to approximate the volume of first channel 34. It can be appreciated that the geometrical properties of first and second channels 34 and 50**, respectively, can be varied without deviating from the scope of the present invention.

In operation, as fluid in second channel 50 increases, first enlarged droplet **66*a* increases in volume such that a second enlarged droplet 66*b* is formed within droplet receiving region 24. As best seen in FIG. 3, edge 58 at the intersection of outer wall 56 and upper surface 20 acts to pin outer surface 67 of second enlarged droplet 66*b* and retain the fluid of second enlarged droplet 66*b* within second channel 50. As additional fluid is added to second enlarged droplet 66*b*, e.g. by the adding of a reagent or a buffer directly to second enlarged droplet 66*b*, the size of second enlarged droplet 66*b* increases and the surface area of outer surface 67 of second enlarged droplet 66*b* at edge 58 increases. When the internal pressure of second enlarged droplet 66*b* pinned at edge 58 exceeds a threshold, droplet 66*b* breaks, thereby causing the fluid of second enlarged droplet 66*b* to spill over edge 58 and flow radially outward toward. Hence, if can be appreciated that additional fluid constraints, in the form of additional, radially spaced concentric channels may be provided within droplet receiving region 24 in upper surface of plate 11 to allow for additional dilutions of second enlarged droplet 66*b***.

Figure 4:
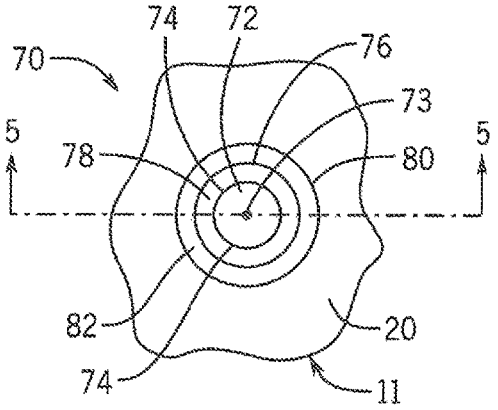
FIG. 4 is a top plan view of an alternate embodiment of a droplet retaining region in accordance with the present invention.
Figure 5:
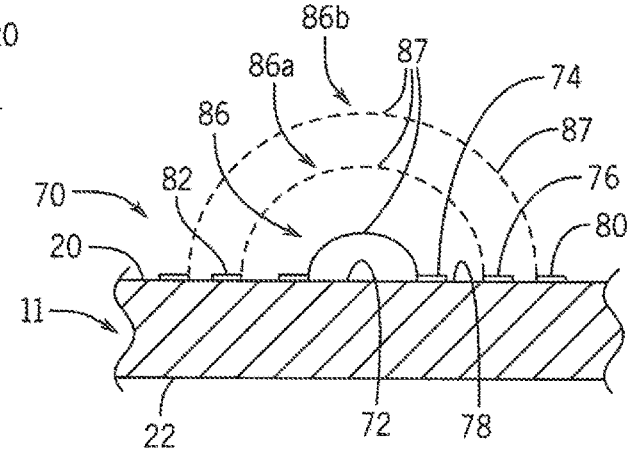
FIG. 5 is a cross-sectional view of the droplet retaining region of the present invention taken along line 5-5 of FIG. 4.

Referring to FIGS. 4-5, an alternate embodiment of a droplet receiving region on upper surface 20 of plate 11 is generally designated by the reference numeral 70. Droplet receiving region 70 includes an initial droplet receiving portion 72 of upper surface 20 which is centered at center 73. In the depicted embodiment, droplet receiving portion 72 has a generally circular cross section. However, it can be appreciated that droplet receiving portion 72 can have other configurations without deviating from the scope of the present invention. By way of example, droplet receiving portion 72 is defined by a generally circular first hydrophobic region 74 extending along upper surface 20 and being centered about center 73. It can be appreciated that first hydrophobic region 74 can have other configurations without deviating from the scope of the present invention.

Each droplet receiving region 70 also includes a generally circular second hydrophobic region 76 extending along upper surface 20 and being centered about center 73. Second hydrophobic region 76 extends about and radially spaced from first hydrophobic region 74 by a first enlarged droplet receiving portion 78 of upper surface of plate 11. It can be appreciated that second hydrophobic region 76 and first enlarged droplet receiving portion 78 of upper surface 20 can have other configurations without deviating from the scope of the present invention.

Each droplet receiving region 70 also includes a generally circular third hydrophobic region 80 extending along upper surface 20 and being centered about center 73. Third hydrophobic region 80 extends about and radially spaced from second hydrophobic region 76 by a second enlarged droplet receiving portion 82 of upper surface 20 of plate 11. It can be appreciated that third hydrophobic region 80 and second enlarged droplet receiving portion 82 of upper surface 20 can have other configurations without deviating from the scope of the present invention.

In operation, it is contemplated to deposit on a droplet, generally designated by the reference numeral 86, on one or more droplet receiving regions 70 of plate 11. By way of example, a robotic micropipetting station (not shown) may be used to dispense droplets 86 onto droplet receiving regions 70 of plate 11 with a high degree of speed, precision, and repeatability. Each droplet 86 is initially received on droplet receiving portion 72 of droplet receiving region 70. The droplet 86 is retained within droplet receiving portion 72 by various fluidic constraints (e.g., hydrophobicity, surface tension, geometry). More specifically, first hydrophobic region 74 retains a first threshold volume of fluid within droplet receiving portion 72. With droplet 86 received within droplet receiving portion 72, first hydrophobic region 74 acts to pin outer surface 87 of droplet 86 and retain the fluid of droplet 86 within droplet receiving portion 72. As additional fluid is added to droplet 86, e.g. by the adding of a reagent or a buffer directly to droplet 86, it can appreciated that size of droplet 86 increases and the surface area of outer surface 87 of droplet 86 at first hydrophobic region 74 increases. When the internal pressure of droplet 86 pinned at first hydrophobic region 74 exceeds a threshold, droplet 86 breaks, thereby causing the fluid of droplet 86 to spill over first hydrophobic region 74 and flow radially outward from droplet receiving portion 72 and first hydrophobic region 74 onto first enlarged droplet receiving portion 78 and toward second hydrophobic region 76, as hereinafter described.

Once fluid of droplet 86 spills over first hydrophobic region 74, the fluid flows radially outward onto first enlarged droplet receiving portion 78 and toward second hydrophobic region 76. As the fluid engages second hydrophobic region 76, the size and shape of droplet 86 are no longer governed by the fluidic characteristics of first hydrophobic region 74, but by the various fluidic constraints of second hydrophobic region 76 (e.g., hydrophobicity, surface tension, geometry). More specifically, as fluid in first enlarged droplet receiving portion 78 increases, droplet 86 increases in volume such that a first enlarged droplet 86*a* is formed within droplet receiving region 70. As best seen in FIG. 5, second hydrophobic region 76 acts to pin outer surface 87 of first enlarged droplet 86*a* and retain the fluid of first enlarged droplet 86*a* within first enlarged droplet receiving portion 78. In the event that additional fluid is added to first enlarged droplet 86*a*, e.g. the adding of a reagent or a buffer directly to first enlarged droplet 86*a*, it can appreciated that size of first enlarged droplet 86*a* increases and the surface area of outer surface 87 of first enlarged droplet 86*a* at second hydrophobic region 76 increases. When the internal pressure of first enlarged droplet 86*a* pinned at second hydrophobic region 76 exceeds a threshold, droplet 86*a* breaks, thereby causing the fluid of first enlarged droplet 86*a* will spill over second hydrophobic region 76 and flow radially outward toward second channel 50, as hereinafter described.

Once fluid of first enlarged droplet 86*a* spills over second hydrophobic region 76, the fluid from first enlarged droplet receiving portion 78 and second hydrophobic region 76 flows radially outward from toward third hydrophobic region 80. As the fluid engages third hydrophobic region 80, the size and shape of first enlarged droplet 86*a* are no longer governed by the fluidic characteristics of second hydrophobic region 76, but by the various fluidic constraints of third hydrophobic region 80 (e.g., hydrophobicity, surface tension, geometry). More specifically, as fluid in second enlarged droplet receiving portion 82 increases, first enlarged droplet 86*a* increases in volume such that a second enlarged droplet 86*b* is formed within droplet receiving region 70. As best seen in FIG. 5, third hydrophobic region 80 acts to pin outer surface 87 of second enlarged droplet 86*b* and retain the fluid of second enlarged droplet 86*b* within second enlarged droplet receiving portion 82. In the event that additional fluid is added to second enlarged droplet 86*b*, e.g. by the adding of a reagent or a buffer directly to second enlarged droplet 86*b*, it can appreciated that size of second enlarged droplet 86*b* increases and the surface area of outer surface 87 of second enlarged droplet 86*b* at third hydrophobic region 80 increases. When the internal pressure of second enlarged droplet 86*b* pinned at third hydrophobic region 80 exceeds a threshold, droplet 86*b* breaks, thereby causing the fluid of the fluid of second enlarged droplet 86*b* to spill over third hydrophobic region 80 and flow radially outward. Hence, it can be appreciated that additional fluid constraints, in the form of additional, radially spaced concentric hydrophobic regions may be provided within droplet receiving region 70 in upper surface 20 of plate 11 to allow for additional dilutions of third enlarged droplet 86*b*.

Figure 6:
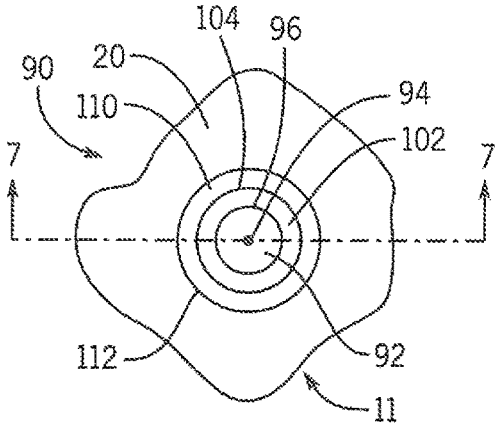
FIG. 6 is a top plan view of a still further embodiment of a droplet retaining region in accordance with the present invention.
Figure 7:
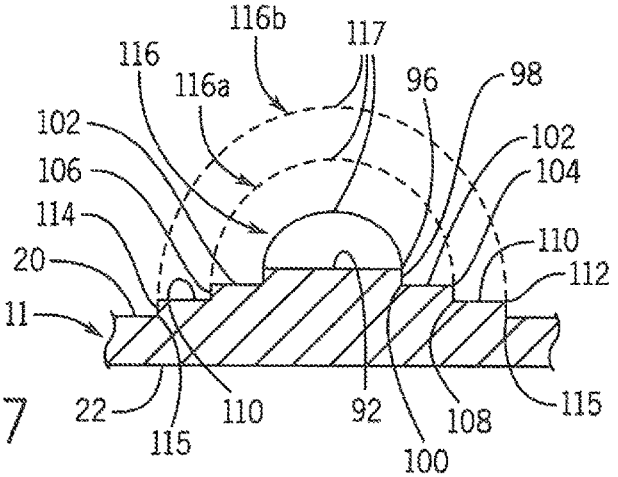
FIG. 7 is a cross-sectional view of the droplet retaining region of the present invention taken along line 7-7 of FIG. 6.

Referring to FIGS. 6-7, an alternate embodiment of a droplet receiving region on upper surface 20 of plate 11 is generally designated by the reference numeral 90. Droplet receiving region 90 includes first land 92 centered at center 94. In the depicted embodiment, first land 92 has a generally circular cross section. However, it can be appreciated that first land 92 can have other configurations without deviating from the scope of the present invention. By way of example, first land 92 is defined by a generally circular surface having a radially outer edge 96 from which first wall 98 depends. First wall 98 is generally perpendicular to first land 92 and upper surface 20, and is radially spaced from center 94. First wall 98 terminates at a generally circular lower edge 100.

Each droplet receiving region 90 also includes a generally circular second land, designated by the reference numeral 102, extending radially from lower edge 100 of wall 98 and vertically spaced from first land 92. It can be appreciated that second land 102 can have other configurations without deviating from the scope of the present invention. As best seen in FIGS. 6-7, second land 102 is defined by a generally circular surface having a radially outer edge 104 from which second wall 106 depends. Second wall 106 is generally perpendicular to second land 102 and upper surface 20, and is radially spaced from center 27. Second wall 106 terminates at a generally circular lower edge 108.

A generally circular third land, designated by the reference numeral 110, extending radially from lower edge 108 of second wall 106 and vertically spaced from first and second land 92 and 102, respectively. It can be appreciated that third land 110 can have other configurations without deviating from the scope of the present invention. Third land 110 is defined by a generally circular surface having a radially outer edge 112 from which third wall 114 depends. Third wall 114 is generally perpendicular to third land 112 and upper surface 20, and is radially spaced from center 27. Third wall 114 terminates at a generally circular lower edge 115 which intersects upper surface 20 of plate 11.

In operation, it is contemplated to deposit on a droplet, generally designated by the reference numeral 116, on one or more droplet receiving regions 90 of plate 11. By way of example, a robotic micropipetting station (not shown) may be used to dispense droplets 116 onto droplet receiving regions 90 of plate 11 with a high degree of speed, precision, and repeatability. Each droplet 116 is initially received on first land 92 of droplet receiving region 90. The droplet 116 is retained on first land 92 by various fluidic constraints (e.g., hydrophobicity, surface tension, geometry). More specifically, first land 92 receives a threshold volume of fluid. With the fluid of droplet 116 received on first land 92, edge 96 at the intersection of first land 92 and first wall 98 acts to pin outer surface 117 of droplet 116 and retain the fluid of droplet 116 on first land 92. As additional fluid is added to droplet 116, e.g. by the adding of a reagent or a buffer directly to droplet 116, it can appreciated that size of droplet 116 increases and the surface area of outer surface 117 of droplet 116 at edge 30 increases. When the internal pressure of outer surface 117 of droplet 116 pinned at edge 96 exceeds a threshold, droplet 116 breaks, thereby causing the fluid of droplet 116 to spill over edge 96 and onto second land 102, as hereinafter described.

Once fluid of droplet 116 spills over edge 98, the fluid flows onto second land 102 towards edge 104. As the fluid is received on second land, the size and shape of droplet 116 are no longer governed by the fluidic characteristics of edge 98, but by the various fluidic constraints of second land 102 and edge 104 thereof (e.g., hydrophobicity, surface tension, geometry). More specifically, as fluid on second land 102 increases, droplet 116 increases in volume such that a first enlarged droplet 116*a* is formed within droplet receiving region 90. As best seen in FIG. 7, edge 104 at the intersection of second land 102 and second wall 106 acts to pin outer surface 117 of first enlarged droplet 16*a* and retain the fluid of first enlarged droplet 116*a* on second land 102. In the event that additional fluid is added to first enlarged droplet 116*a*, e.g. by the adding of a reagent or a buffer directly to first enlarged droplet 116*a*, it can appreciated that size of first enlarged droplet 116*a* increases and the surface area of outer surface 117 of first enlarged droplet 116*a* at edge 104 increases. When the internal pressure of first enlarged droplet 116*a* pinned at edge 104 exceeds a threshold, droplet 116*a* breaks, thereby causing the fluid of first enlarged droplet 116*a* to spill over edge 104 and onto third land 110, as hereinafter described.

Once fluid of first enlarged droplet 16*a* spills over edge 104, the fluid flows onto third land 110 towards edge 115. As the fluid is received on third land 110, the size and shape of first enlarged droplet 116*a* are no longer governed by the fluidic characteristics of edge 104, but by the various fluidic constraints of third land 110 and edge 115 thereof (e.g., hydrophobicity, surface tension, geometry). More specifically, as fluid on third land 110 increases, first enlarged droplet 116*a* increases in volume such that a second enlarged droplet 116*b* is formed within droplet receiving region 90. As best seen in FIG. 7, edge 115 at the intersection of third land 110 and third wall 114 acts to pin outer surface 117 of second enlarged droplet 116*b* and retain the fluid of second enlarged droplet 116*b* on second land 110. In the event that additional fluid is added to second enlarged droplet 116*b*, e.g. by the adding of a reagent or a buffer directly to first enlarged droplet 116*b*, it can appreciated that size of second enlarged droplet 116*b* increases and the surface area of outer surface 117 of second enlarged droplet 116*b* at edge 115 increases. When the internal pressure of second enlarged droplet 116*b* pinned at edge 115 exceeds a threshold, droplet 116*b* breaks, thereby causing the fluid of second enlarged droplet 116*b* will spill over edge 115 and onto outer surface 20 of plate 11. Hence, if can be appreciated that additional fluid constraints, in the form of additional, radially spaced concentric channels may be provided within droplet receiving region 90 in upper surface 20 of plate 11 to allow for additional dilutions of second enlarged droplet 116*b*.

Various modes of carrying out the invention are contemplated as being within the scope of the following claims particularly pointing out and distinctly claiming the subject matter, which is regarded as the invention.

We claim:

1. A microfluidic device, comprising:

a plate having an upper surface and including:

a central region communicating with the upper surface and being adapted for receiving a droplet of fluid, the central region including an outer periphery defining a first fluid constraint configured for discouraging fluid on the central region from flowing therepast when the droplet of fluid is received on the central region;

a second fluid constraint surrounding the first fluid constraint, the second fluid constraint configured for discouraging fluid from the droplet of fluid received on the central region which flows past the first fluid constraint from flowing therepast; and a third fluid constraint surrounding the second fluid constraint, the third fluid constraint configured for discouraging fluid from the droplet of fluid received on the central region which flows past the first and second fluid constraints from flowing therepast.

2. The device of claim 1 wherein the central region defines a recess formed in the upper surface of the plate, the recess defined by a closed bottom spaced from the upper surface by a first sidewall.

3. The device of claim 2 wherein the first sidewall intersects the upper surface at an edge, the edge defining the first fluid constraint.

4. The device of claim 2 wherein the plate includes a first channel in the upper surface, the first channel extending about the first sidewall and being defined by a first recessed surface spaced from the upper surface by a second sidewall.

5. The device of claim 4 wherein the second sidewall intersects the upper surface at an edge, the edge defining the second fluid constraint.

6. The device of claim 4 wherein the plate includes a second channel in the upper surface, the second channel extending about the second sidewall and being defined by a second recessed surface spaced from the upper surface by a third sidewall.

7. The device of claim 6 wherein the third sidewall intersects the upper surface at an edge, the edge defining the third fluid constraint.

8. The device of claim 6 wherein the first channel has a volume, the volume of the first channel being greater than a volume of the second channel.

9. The device of claim 1 wherein the first fluid constraint includes a first hydrophobic ring extending along the outer periphery of the central region.

10. The device of claim 9 wherein the second fluid constraint includes a second hydrophobic ring extending about the first fluid constraint, the second hydrophobic ring being radially spaced from the first hydrophobic ring.

11. The device of claim 10 wherein the third fluid constraint includes a third hydrophobic ring extending about the second fluid constraint, the third hydrophobic ring being radially spaced from the second hydrophobic ring.

12. The device of claim 1 further comprising a first sidewall having a first end intersecting the outer periphery of the central region at a first edge and a second end, the first edge defining the first fluid constraint.

13. The device of claim 12 further comprising:

a first ledge extending radially from the second end of the first sidewall and terminating at a terminal first edge, the terminal first edge defined the second fluid constraint; and a second sidewall depending from the terminal first edge and terminating at a lower end.

14. The device of claim 13 further comprising a second ledge extending radially from the lower end of the second sidewall and terminating at a terminal second edge, the terminal second edge defining the third fluid constraint.

15. A device for containing a droplet having an outer surface at a predetermined location, the droplet having an internal pressure, the device comprising a microfluidic device having a surface;

a first fluid constraint surrounding a first droplet area for receiving the droplet therein, the first fluid restraint configured for maintaining the droplet within the first droplet area in response to the internal pressure of the droplet failing to exceed a first threshold;

a second fluid constraint surrounding and spaced from the first fluid constraint by a second droplet area for receiving the droplet thereon, the second fluid restraint configured for maintaining at least a portion of the droplet within the second droplet area in response to the internal pressure of the droplet failing to exceed a second threshold; and a third fluid constraint surrounding and spaced from the second fluid constraint by a third droplet area for receiving the droplet thereon, the third fluid restraint configured for maintaining at least a portion of the droplet within the third droplet area in response to the internal pressure of the outer surface of the droplet failing to exceed a third threshold.

16. The device of claim 15 wherein:

the first droplet area is defined a recess formed in the surface of the microfluidic device, the recess being defined by a closed bottom spaced from the surface by a first sidewall; and the first sidewall intersects the surface at a first edge, the first edge defining the first fluid constraint.

17. The device of claim 16 further comprising a first channel in the upper surface, the first channel extending about the first sidewall and being defined by a first recessed surface spaced from the upper surface by a second sidewall, wherein the second sidewall intersects the surface at a second edge, the second edge defining the second fluid constraint.

18. The device of claim 17 further comprising a second channel in the surface, the second channel extending about the second sidewall and being defined by a second recessed surface spaced from the surface by a third sidewall, wherein the third sidewall intersects the surface at a third edge, the third edge defining the third fluid constraint.

19. The device of claim 18 wherein the first channel has a volume, the volume of the first channel being generally equal to a volume of the second channel.

20. The device of claim 15 wherein the first, second and third fluid constraints are defined by corresponding concentric hydrophobic bands radially spaced from each other along the surface of the microfluidic device.

21. The device of claim 15 further comprising a fluid retainer extending from the surface of the microfluidic device and being defined by a plurality of steps such that the fluid retainer has a stepped pyramid configuration, each step including a rise generally perpendicular to the surface and a landing generally parallel to the surface wherein the intersection of each rise and landing combination defines a corresponding one of the first, second and third fluid constraints.

22. A method for containing an expandable droplet at a predetermined location along a surface of a microfluidic device, comprising the steps of:

providing a plurality of radially spaced fluid constraints about a droplet deposit region of the surface of the microfluidic device;

depositing a droplet on the droplet deposit region of the surface of the microfluidic device;

retaining the droplet within a first fluid constraint of the plurality of radially spaced fluid constraints if an internal pressure of the droplet is less than a first threshold;

retaining the droplet within a second fluid constraint of the plurality of radially spaced fluid constraints if the internal pressure of the droplet is less than a second threshold; and retaining the droplet within a third fluid constraint of the plurality of radially spaced fluid constraints if the internal pressure of the droplet is less than a third threshold;

wherein:

the second fluid constraint surrounds the first fluid constraint; and the third fluid constraint surrounds the second fluid constraint.

23. The method of claim 22 wherein:

the droplet deposit region includes a recess formed in the surface of the microfluidic device, the recess being defined by a closed bottom spaced from the surface by a first sidewall; and the first sidewall intersects the surface at a first edge, the first edge defining the first fluid constraint.

24. The method of claim 23 comprising the additional step of providing a first channel in the upper surface, the first channel extending about and being radially spaced from the first sidewall and being defined by a first recessed surface spaced from the surface of the microfluidic device by a second sidewall, wherein the second sidewall intersects the surface at a second edge that defines the second fluid constraint.

25. The method of claim 24 further comprising the additional step of providing a second channel in the surface, the second channel extending about and being radially spaced from the second sidewall and being defined by a second recessed surface spaced from the surface by a third sidewall, wherein the third sidewall intersects the surface at a third edge that defines the third fluid constraint.

26. The method of claim 25 wherein the first channel has a volume, the volume of the first channel being generally equal to a volume of the second channel.

27. The method of claim 22 wherein the first, second and third fluid constraints are defined by corresponding concentric hydrophobic bands radially spaced from each other along the surface of the microfluidic device.

28. The method of claim 22 further comprising the step of providing a fluid retainer extending from the surface of the microfluidic device and being defined by a plurality of steps such that the fluid retainer has a stepped pyramid configuration, each step including a rise generally perpendicular to the surface and a landing generally parallel to the surface wherein the intersection of each rise and landing defines a corresponding one of the first, second and third fluid constraints.

* * * * *